US007024126B2

(12) United States Patent
Kellie et al.

(10) Patent No.: US 7,024,126 B2
(45) Date of Patent: Apr. 4, 2006

(54) DEVELOPING UNIT AND DENSITY CONTROL METHOD IN ELECTROPHOTOGRAPHY

(75) Inventors: Truman F. Kellie, Lakeland, MN (US); William D. Edwards, New Richmond, WI (US)

(73) Assignee: Samsung Electronics Co., Ltd., Suwon-City (KR)

( * ) Notice: Subject to any disclaimer, the term of this patent is extended or adjusted under 35 U.S.C. 154(b) by 0 days.

(21) Appl. No.: 11/086,484

(22) Filed: Mar. 22, 2005

(65) Prior Publication Data

US 2005/0169671 A1 Aug. 4, 2005

Related U.S. Application Data

(63) Continuation-in-part of application No. 10/387,191, filed on Mar. 11, 2003.

(60) Provisional application No. 60/368,254, filed on Mar. 28, 2002.

(51) Int. Cl.
*G03G 15/10* (2006.01)

(52) U.S. Cl. ..... 399/57; 399/237; 399/240; 430/117

(58) Field of Classification Search ..... 399/57, 399/237, 239, 240, 238, 248
See application file for complete search history.

(56) References Cited

U.S. PATENT DOCUMENTS

| | | | | |
|---|---|---|---|---|
| 4,468,112 A | | 8/1984 | Suzuki et al. | 399/29 |
| 4,533,234 A | | 8/1985 | Watai et al. | 399/49 |
| 4,639,117 A | | 1/1987 | Murai et al. | 399/60 |
| 5,408,070 A | * | 4/1995 | Hyllberg | 219/469 |
| 5,666,615 A | * | 9/1997 | Nguyen | 399/240 |
| 5,724,629 A | * | 3/1998 | Iino et al. | 399/57 |
| 5,812,903 A | | 9/1998 | Yamada et al. | 399/42 |
| 5,826,148 A | * | 10/1998 | Iino et al. | 399/240 |
| 5,933,685 A | | 8/1999 | Yoo | 399/57 |
| 5,937,229 A | | 8/1999 | Walgrove et al. | 399/68 |
| 6,115,561 A | | 9/2000 | Fukushima | 399/49 |
| 6,701,111 B1 | * | 3/2004 | Park et al. | 399/239 |
| 6,766,130 B1 | | 7/2004 | Song et al. | 399/238 |
| 2003/0044202 A1 | * | 3/2003 | Song et al. | 399/238 |

FOREIGN PATENT DOCUMENTS

| | | | |
|---|---|---|---|
| JP | 09-015982 A | * | 1/1997 |
| JP | 2000-199996 A | * | 7/2000 |

* cited by examiner

*Primary Examiner*—Sophia S. Chen
(74) *Attorney, Agent, or Firm*—Mark A. Litman & Associates, P.A.

(57) ABSTRACT

A developing unit maintains constant density in an electrophotographic imaging process. The developing unit has:

a) a developer with a developing surface and a first voltage is applied to the developer;

b) a depositor, wherein said depositor is positioned to maintain a gap with the developer and a second voltage is applied to the depositor;

c) a cleaning device for said developer, wherein the cleaning device is in contact with the developer; and d) an ink container, wherein the developer, the depositor and the cleaning device are inside the ink container.

19 Claims, 2 Drawing Sheets

DEVELOPING UNIT AND DENSITY CONTROL METHOD IN ELECTROPHOTOGRAPHY

RELATED APPLICATION DATA

This application is a continuation-in-part application of U.S. patent application Ser. No. 10/387,191, filed Mar. 11, 2003, titled "A DEVELOPING UNIT AND DENSITY CONTROL METHOD IN ELECTROPHOTOGRAPHY," which in turn claims priority from Provisional U.S. patent application Ser. No. 60/368,254, filed Mar. 28, 2002.

BACKGROUND OF THE INVENTION

1. Field of Invention

This invention relates to a novel electrophotographic apparatus and process suitable for use in electrophotography and, more specifically, to a developing unit and a method for controlling the consistency of density in an electrophotographic process.

2. Background

It is often useful to print large quantities of multi-colored prints to paper for the purpose of disseminating multiple copies of reports or brochure information. One objective of this kind of printing is that all the reports or brochures look the same, which means that all the printing of the color and monochrome pages must maintain a consistent density as printing progresses. It is not desirable to allow the densities of primary colors to vary from page to page because the final product of the reports and/or brochures will be degraded if the colors are varying from document to document. Therefore it is important to measure and control the density of images (i.e., plated toner or ink) during the printing process to assist in maintaining constant density during the printing process.

To accomplish the printing of constant density images over time in the printing process or other electrophotographic applications, several methods have been described. One attempt disclosed in U.S. Pat. No. 5,243,391 (Williams) is a system that measures the percent solids in the ink solution as an electrical resistance and then adjusts the gap between the developing element and the ink receptor to modify the electric field in the printing nip. This kind of hardware is both costly and difficult to maintain in the liquid ink environment.

Another example of an image control system is in U.S. Pat. No. 5,933,685 (Yoo) which uses the detection of ink solids by optical means. No provision is made for detecting ink conductivity. However, constant density printing can occur with this arrangement only if the ink conductivity remains constant in the presence of decreasing ink solids and ink conductivity is not considered by this process. A similar method also uses ink concentration sensing for print density control but also fails to account for ink conductivity variations that may affect print density.

Many attempts (for example, U.S. Pat. No. 4,468,112 to Suzuki) are found that try to overcome the above defined problem of image density variation other than by sensing the toner concentration control in the developing unit. These methods of print density control need a test patch (i.e., reference image on a patch) to be prepared separately from an output image, the density of the reference image which has been developed is then measured, and the toner is supplied such that its density assumes a prescribed value. In this method, since in many cases an-electrostatic image of the reference patch is always developed under constant potential contrast, the fact that the density of the patch assumes a prescribed value means that the ink concentration is variably controlled so that the toner charge amount is maintained at a constant level. These attempts also further require a density measuring system to measure the density of the test patch. All such similar methods require recording, developing and measuring steps that may add cost and complexity to the printing hardware. Another similar approach (e.g., U.S. Pat. No. 6,115,561 to Fukushima) uses a special pattern in the imaging system along with a lookup table, but the density measurement of the special pattern is still required or else the measurement needs more than just one special pattern. Clearly, the previous methods for print density control with respect to time all need special hardware in addition to the printing hardware, and many also need the involvement of the ink receptor where test patches must be printed and analyzed.

One method as disclosed in, for example, Japanese unexamined Patent Publication Nos. 108070/1989, 314268/1989, 8873/1990, 110476/1990, 75675/1991, and 284776/1991, is the use of a pixel counting method wherein the image density of an output image or the number of pixels that are written is counted, and the amount of toner consumption is estimated in a corresponding manner so as to supply the toner. This is a method in which the amount of toner that to be consumed for forming a dot is assumed. With this method, there has been the problem that even if the toner supply error may be very small in each print, the errors accumulate over a long term, leading to a large toner concentration error in the final run.

Published U.S. Patent Application No. 2003/0044202, filed May 13, 2002, now U.S. Pat. No. 6,766,130 describes a liquid developer imaging system and a method using the system for developing an image, including a cartridge for containing a developing solution; a developing container for receiving the developing solution supplied from the cartridge via a predetermined supply line; a developing roller partly submerged in the developing solution contained in the developing container, installed to be rotated facing a photosensitive object; and a metering blade for scraping off the developing solution coated on the surface of the developing roller to a predetermined thickness, is provided. According to the system, a developing supply structure can be considerably simplified because a high-density developing solution is directly used in developing an image without a process of diluting the solution, and an image can be developed to have high definition because the concentration of the developing solution coated on the developing roller is regularly controlled by a metering blade.

SUMMARY OF THE INVENTION

The present invention relates to the control of print density in the output from a printing machine by utilizing a developing unit that has been equipped with current measuring means. Specifically, at least one color of ink may be printed to a desired density by this developing unit and the print density of that color will be held constant throughout the useful life of the ink cartridge. The level of ink in this developing unit should or must be held to within specified limits of a set point level by the addition of pure carrier solvent as printing progresses. Use of one, two, three or four such units each of which prints one primary color may be utilized to produce full color images with all colors printed at their target densities for the useful lives of their respective ink cartridges.

In a first aspect, the invention features a developing unit that includes: (a) a developer, wherein the developer comprises a surface and a first voltage is applied to the developer roll; (b) a depositor (e.g., the element, usually in the form of a roller or otherwise opposed surface to the developer roll, that establishes a bias charge with the developer roll across the intervening ink), wherein the depositor is positioned to maintain a gap with the developer and a second voltage is applied to the depositor roll; c) a current measuring system connected to said depositor and said developer roll for measuring current flow between said depositor and said developer roll; (d) a cleaning device for the developer roll, wherein the cleaning device is in contact with the developer roll; and (e) an ink container, wherein the developer roll, the depositor and the cleaning device are inside the ink container. The current measuring system may be used in conjunction with a look-up table to determine the amount of available image capacity that remains in the ink in the system.

In a second aspect, the invention features a method for maintaining constant density in an imaging process such as electrography, electrophotography or printing that includes: (a) providing a developing unit comprising a developer roll, a depositor, a cleaning device, and an ink container, wherein the developer roll, the depositor and the cleaning device are inside the ink container; (b) moving said developer roll; (c) providing an ink in the ink container; (d) applying a first voltage to the developer roll; (e) applying a second voltage to the depositor; and (f) controlling a plating current between the developer roll and the depositor to obtain a constant thickness of ink plated on a surface of the developer roll by adjusting the first voltage, the second voltage, or a combination of thereof.

BRIEF DESCRIPTION OF THE FIGURES

Aspects, advantages and features of the present invention will be more readily understood from the following detailed description of certain preferred embodiments thereof, when considered in conjunction with the accompanying drawings in which.

DETAILED DESCRIPTION OF THE INVENTIONt

Figure 1:
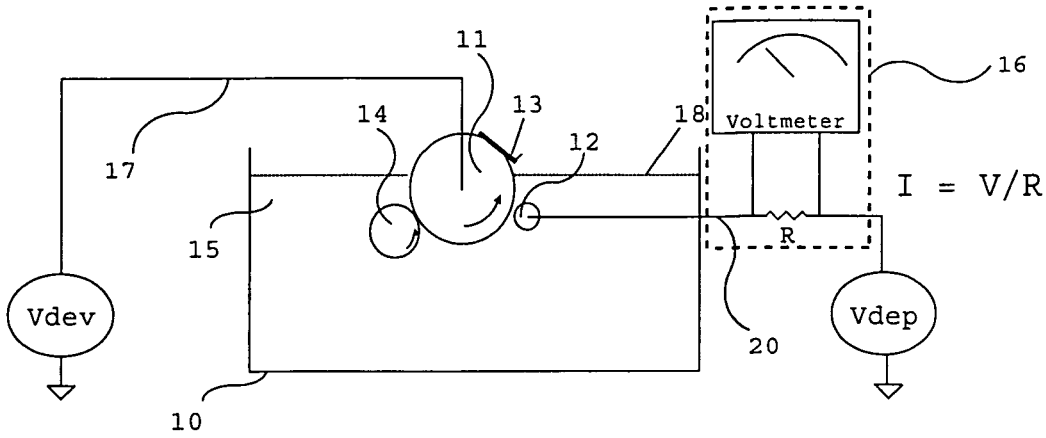
FIG. 1 is a schematic diagram of a developing unit, equipped with a skive blade in an ink container filled with liquid toner to a prescribed level, further comprising one embodiment of a current measuring means.

One format of an electrophotographic system functions by providing an ink supply having both a developer roll and a depositor forming an electrical bias between the developer roll and the depositor through the conductivity of the ink. The depositor establishes a differential voltage across the ink to the developer roll, and when the differential is sufficiently large, charged particles in the ink deposit either on the developer roll or on the depositor. To make this system function, at least three conditions must be met. (The third condition is that the ink must be charged in such a manner that the ink particles migrate (plate) to the developer roll rather than to the depositor.) The voltage differential (the bias charge) must be sufficiently large so as to cause concentrated liquid comprising the charged particles in their carrier to deposit strongly (referred to in the electrophotographic art as plating) onto the surface of the developer roll, and there must be sufficient concentration of particles in the ink so that the applied voltage differential (at the speed of rotation of the developer roll) will be able to plate a sufficient amount of ink onto the developer roll. During use of this electrophotographic system, certain phenomena occur that alter the quality of performance of the system. As particles in the ink are used to plate the developer roll and assist in the printing of images, the ambient concentration of particles in the ink decreases. This decrease in the concentration of conductive particles increases the electrical resistance (reduces the conductivity) of the ink between the depositor and the developer roll. As a standard constant voltage differential is maintained across the developer roll and the depositor, less and less concentration of ink will be plated on the developer roll as the particles are depleted. This leads to a reduction in image density on a point-by-point basis in the image, as less ink is available for transfer to an electrophotographic latent image on a photoconductor. Inconsistency in image density reproduction is therefore increased.

The plating of the ink is accomplished by the formation of a relatively concentrated and thin (a few microns, e.g., 1–20 microns) layer of carrier liquid and electrophotographic particles. Typical particle concentrations in these plated layers are between 15 and 30% by volume of particles. For purposes of this discussion, it will be assumed that a preferred range of 20–25% by volume particles/ink will be present, and specifically 22% by volume particles to ink will be present in the plated layer. As the concentration of particles in the ambient ink in the system decreases over use, the concentration of the ink is usually below and at times well below this 22% target for plating. It is therefore important that proper controls be exercised on the system to assure that sufficient amounts of plated ink at the required concentration be plated on the surface of the developer roll.

The underlying principle in the practice of the invention is that the work (electrical work) needed to plate an appropriate layer onto the developer roll remains relatively constant, but as conditions under which the electrical work is performed change (e.g., the conductivity of the ink decreases and its resistivity increases), changes must be made in other parameters of the system to keep the plating consistent. As the electrical properties of the developer roll, the depositor, and the initial ink composition are known, and as the initial voltage applied between the developer roll and the depositor are known, standard relationships can be determined among changing parameters such as current flow between the developer roll and the depositor, resistivity of the ink, particle concentration in the ink, and voltage changes that will be needed to maintain a constant quality of plating.

An electronic look-up table or a mathematical equation based on empirical data is created which relates some of these parameters for subsequent use in the system. This table can be created once and then programmed into the processor or stored in memory for use in electrophotographic systems. One way of doing this is as follows. A standard ink is used to determine the inter-relationship of these parameters. This should be done on a color-by-color basis, as the different color inks will vary somewhat in properties, although an average or standard value could be used where the properties of the four colors or some number of colors has been determined to be sufficiently similar to enable use of a single table. The ink is used in a system with standard developer roll and depositor. Images of known percentage of coverage are made on the system and various data selected from the following are taken: 1) the concentration of the particles in the ink, 2) resistivity of the ink; 3) image density; voltage differential between the developer roll and the depositor; current flow between the depositor and the developer roll; and changes in the voltage or current that must be made to maintain image density in a printed image based upon standard or given signals. Once this data has been developed, and the lookup table constructed, a simple system may be established for automatically correcting image density variation from this phenomenon or the system may alert a user that changes must be performed on the electrical work parameters to maintain image density.

Once the look-up table has been constructed, the following types of relationships can be established and related. A measured resistivity of the ink indicates a specific concentration of particles in the ink. This is a measure of an approximate available life of the ink in the system and can be related to the approximate number of images or imaging time available with that particular ink. The resistance of the ink can be measured in real time on the basis of an electrical relationship. For example, because the differential voltage, $V_D$, is known between the developer roll and the depositor and the current, I, can be measured, the resistance of the ink, $R_i$, can be obtained by the following equation where $R_{dev}$, the resistance of the developer, and $R_{dep}$, the resistance of the depositor, are known and constant:

$$V_D/I=R_{dev}+R_{dep}+R_i$$

By measuring changes or the state of any two of these electrical properties in the electrophotographic system, the value of the third can be determined and the concentration of the particles in the ink can likewise be determined with a level of accuracy sufficient to warrant adjustment of the system to compensate for changes in that concentration. It should be remembered that the voltage differential is not only measurable at any time, it is actively controlled by the system. Therefore by measuring the voltage on the developer roll and the voltage on the depositor, the differential is known. Plating intensity, that is, the electrical force/work driving the plating is controlled by changing this differential, usually by changing the voltage on the depositor. Current can be measured by placing an ammeter in the system between a power supply and the depositor, for example. The lookup table also has established a relationship between the particle concentration in the ink and the work that must be done to plate the desired layer of ink onto the developer roll. As the electrical resistance of the ink identifies the ambient concentration of particles in the ink supply, the electrical work is known which must be used in the system to plate the required ink transfer layer on the developer roll. Therefore the lookup table identifies that when a particular resistance is measured or calculated for the ambient ink supply, the voltage in the system must be at a particular level to assure proper plating from the ambient ink supply at the known concentration. Either the system can then be directed by the processor (computer) to automatically adjust the electrical work parameters (the applied voltage on the depositor) or signal an operator to make the adjustment.

The invention therefore generally describes an ink developing unit comprising:

a) a developer roll comprising a developer roll surface. A first voltage is applied to said developer roll surface while it is in contact with an electrically conductive ink composition;

b) a charge depositor in electrical contact with said electrically conductive ink composition, wherein said charge depositor is positioned to maintain a gap with respect to said developer roll. A second voltage is applied to said depositor establishing a bias voltage or voltage differential between the developer roll and the depositor;

c) a cleaning device for said developer roll that reduces occurrence of non-plated ink on the developer roll after a surface of the developer roll is removed from the conductive ink composition. The cleaning device is in contact with the developer roll surface to physically press or scrape or brush liquid and solid material from the surface of the developer roll or the surface of plated ink on the developer roll; and d) a system for measuring electrical properties in the ink developing unit. These properties can be used to measure or determine resistance in or current through the ink composition or measure or determine electrical properties from which the resistance of the ink can be measured;

Both the developer roll and the depositor device are in physical contact with the ink, the ink being present in the gap between the developer roll and the depositor. The system should be connected to a processor or have a processor in the system that provides a look-up table relating the properties of ink resistance (or a property from which the ink resistance can be determined) to the concentration of particles in the ambient ink. This effectively measures in real time the available life of the ambient ink in the system. By providing an electronic lookup table in the system, specific measurements (e.g., ink conductivity/resistance or current flow across the gap) can be directly related to or translated to properties of the ambient ink composition. Those properties relate to the expected useful life remaining in the ambient ink composition. The system can automatically, systematically, or on demand take measurements of these properties, determine the voltage necessary to maintain a desired or optimal plating of ink composition onto the developer roll, and implement changes in the bias voltage and/or current to effect the desired or optimal plating.

Figure 3:
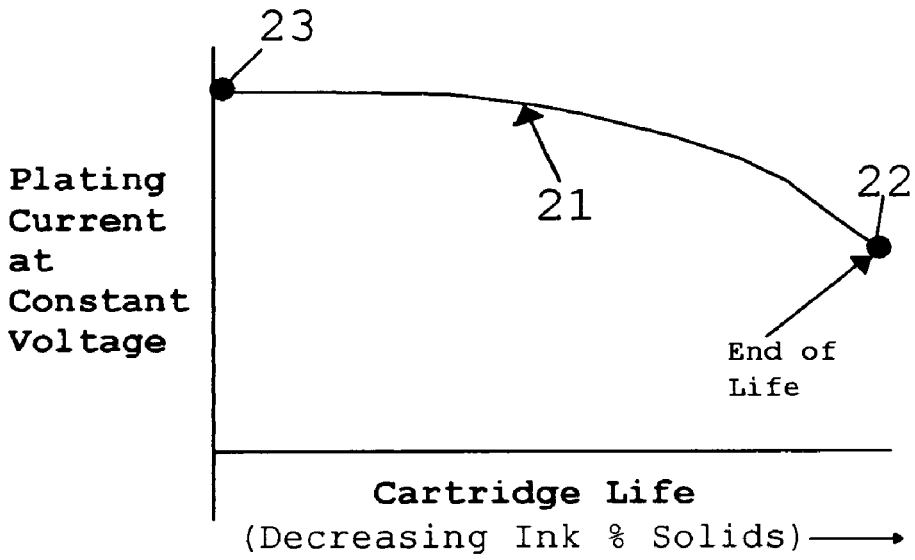
FIG. 3 is a schematic of an alternative developing unit construction.
Figure 4:
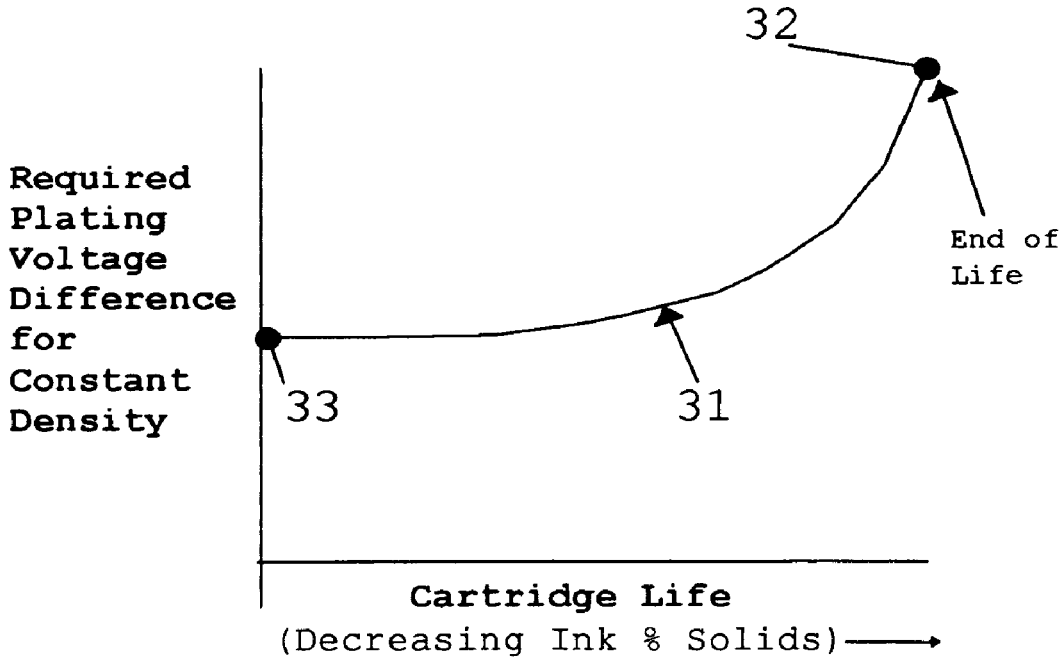
FIG. 4 is a schematic of another alternative developing unit construction.

FIGS. 3 and 4 show graphs of a) the relationship of ink plating current versus ink particle concentration for a constant applied bias voltage and b) applied bias voltage versus ink particle concentration at constant plating density.

Generally, an ink receptor (e.g., photosensitive medium) such as a photosensitive belt or photosensitive drum is used in an electrophotographic printer. The surface of the photosensitive medium can be charged to a required electrical potential and the level of the electric potential can be selectively changed by irradiation, such as by a scanned beam, thereby forming an electrostatic latent image. The printers are generally divided in the art into a dry type and a liquid type according to the state of inks provided to the electrostatic latent image. In a liquid type printer (e.g., liquid electrophotography), a developing unit provides a toner obtained by mixing ink particles and a carrier liquid that is used in printing. The carrier liquid may be selected from a wide variety of materials which are well known in the art. The carrier liquid is typically oleophilic, chemically stable under a variety of conditions, and electrically insulating. "Electrically insulating" means that the carrier liquid has a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar® G liquid, Isopar® H liquid, Isopar® K liquid and Isopar® L liquid (manufactured by Exxon Chemical Corporation, Houston, Tx.). The preferred carrier liquid is Norpar® 12 or Norpar® 15 liquid, also available from Exxon Corporation. The ink particles are comprised of colorant embedded in a thermoplastic resin. The colorant may be a dye or more preferably a pigment. The resin may be comprised of one or more polymers or copolymers which are characterized as being generally insoluble or only slightly soluble in the carrier liquid; these polymers or copolymers comprise a resin core.

Any liquid ink known in the art may be used for the present invention. The liquid inks may be black or may be of different colors for the purpose of plating solid colored material onto a surface in a well-controlled and image-wise manner to create the desired prints. In some cases, liquid inks used in electrophotography are substantially transparent or translucent to radiation emitted at the wavelength of the latent image generation device so that multiple image planes can be laid over one another to produce a multi-colored image constructed of a plurality of image planes with each image plane being constructed with a liquid ink of a particular color. This property is called transmissibility for the wavelength of imaging. Typically, a colored image is constructed of four image planes. The first three planes are constructed with a liquid ink in each of the three subtractive primary printing colors, yellow, cyan and magenta. The fourth image plane uses a liquid black ink, which need not be transparent to radiation emitted at the wavelength of the latent image generation device.

Figure 2:
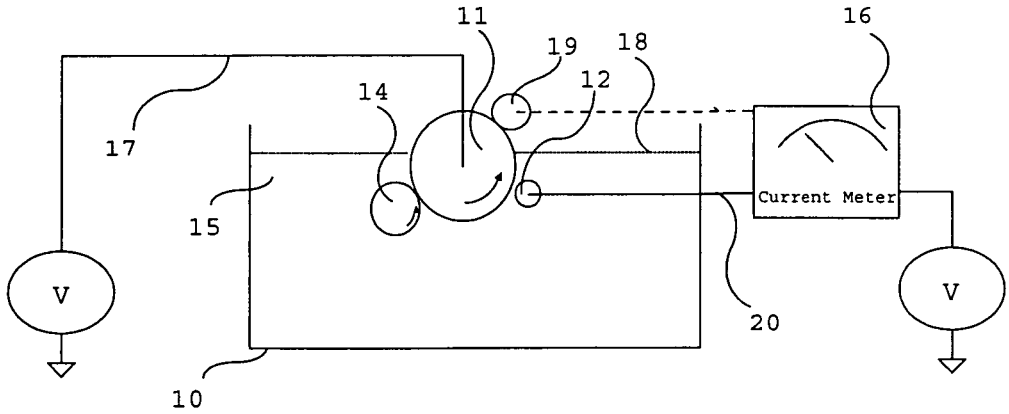
FIG. 2 is a schematic diagram of a developing unit, equipped with a skive roll, filled with liquid toner to a prescribed level, further comprising one embodiment of a current measuring means.

Referring now to FIG. 1 and FIG. 2, a developing unit comprises an ink container 10 to be filled with a liquid ink 15 having an ambient particle concentration and an ambient electrical resistance to a prescribed level 18. The term "ambient" refers to the state of the material or environment at any particular time without imposition of outside influence. Ambient resistance is therefore the resistance measured at any particular time (which ambient resistivity or ambient resistance is dependent upon the concentration of conductive particles in the ambient ink composition.) That concentration changes as the ink composition has been used in imaging operations. Liquid ink 15 consists of the carrier liquid and a positively (or negatively) charged "solid" (hereinafter, a positively charged ink or a negatively charged ink), but not necessarily opaque, toner particles of the desired color for this portion of the image being printed. The charge neutrality of liquid ink 15 is maintained by negatively (or positively) charged counter ions which balance the positively (or negatively) charged pigment particles.

In general, there may be two possible methods of forming visible images on an ink receptor, i.e., moving plated ink layer or particles from developer 11 to an ink receptor (not shown). One method is to use an electrophoretic plating process, i.e., a gapped development, wherein ink particles are suspended in fluid (e.g., carrier liquid) and the particles are caused to migrate and plate to the ink receptor through a gap between the surface of developer 11 and the surface of ink receptor, wherein the gap is filled with carrier material, e.g., carrier liquid, to promote mobility of the ink particles. In this arrangement, the development process is accomplished by using a uniform electric field produced by the voltage bias of developer 11 which is positioned within a few thousandths of an inch from the surface of the ink receptor. In the gapped development process, developer 11 should be a conductive material such as metal, conductive polymer, conductive particle filled polymer, conductive particle filled composites or conductive composites. Overall volume resistivity is a volume resistivity measured after a component is finally constructed (e.g., developer 11), for example, with no over-coat, single layer over-coat, multi-layer over-coated, composite materials used and the like. Developer 11 is constructed with the overall volume resistivity at most about $10^3$ Ω-cm, to avoid introducing unnecessary voltage drops in the developing circuit. The other method is a contact transfer process, i.e., the ink layer is transferred to the ink receptor, wherein the surface of developer 11 is in a mechanical contact with the surface of ink receptor. In this process, the transfer process is accomplished in the developer nip created by the surface of developer 11 and the surface of the ink receptor, and thus the layer of plated ink that lies on the surface of the developer 11 is either accepted by the discharged area of the ink receptor or is rejected by the charged area of the ink receptor. In one embodiment of the present invention, for developer 11 in the contact transfer process, a voltage-biased roll, which is rotating, is used and may be in contact with the ink receptor. Developer 11 is constructed from a less conductive material (less conductive than that of the gapped development, e.g., the overall volume resistivity of developer constructed, being at least $10^5$ Ω-cm) and should also have some degree of mechanical compliance so as not to push the ink from off the surface of the ink receptor. One example of such a roll construction is a metal core of 0.63 cm (0.250 inches) diameter coated with a relatively soft (approximately 30 durometer Shore A hardness, preferably less than about 40 durometer Shore A hardness) and relatively conductive rubber (approximately $10^3$ Ω-cm of volume resistivity, preferably greater than $10^2$ Ω-cm of volume resistivity) to a diameter of 2.18 cm (0.860 inches). The conductive rubber is next coated with a thin (approximately 20 μm, preferably less than 40 μm) coating of a relatively resistive rubber-like layer (approximately $10^{12}$ Ω-cm of volume resistivity, preferably between about $10^{11}$ Ω-cm and $10^{13}$ Ω-cm of volume resistivity) so that the overall volume resistivity of the roll is approximately $10^8$ Ω-cm, preferably between about $10^7$ Ω-cm and $10^9$ Ω-cm of volume resistivity. Another example of such a roll construction is a metal core of 1.27 cm (0.50 inches) in diameter coated with a relatively soft (approximately 30 durometer Shore A hardness, preferably less than 50 durometer Shore A hardness) and relatively conductive rubber-like layer (approximately between $10^{7-109}$, such as $10^8$ Ω-cm of volume resistivity) to a final diameter of 0.860 inches (2.18 cm) and the overall volume resistivity of the roll is approximately between $10^{7-109}$, such as $10^8$ Ω-cm. In experiments, it is shown that the surface velocity of the roll may be in the range of 0.254 cm/sec (0.1 inches per second) to 25.4 cm/sec (10 inches per second) for optimal printing.

Depositor 12 is employed to plate ink solids onto the surface of developer 11, and is accommodated therein such that the depositor is properly positioned to maintain a gap with developer 11, within a few thousandths of an inch. Depositor 12 may be constructed with conductive material such as metal, conductive polymer, conductive particle filled polymer, conductive particle filled composites or conductive composites, with the overall volume resistivity being at most about $10^3$ Ω-cm. Depositor 12 also may be configured to any shape that will support the flow of current between developer 11 and depositor 12, such as an electrode plate, a wire, a roll and the like. In the embodiment of the present invention, a roll is used. The roll can be rotated or remain stationary. Both developer 11 and depositor 12 may be biased with voltages, that is, a first voltage is applied to the developer 11 and a second voltage is applied to the depositor 12 from a power supply and, in this way, voltages of different values may be applied to the two rolls. In the present invention, the gap of 100 μm between developer 11 and depositor 12 is used when the voltage bias for developer 11 is 450V and the voltage bias for depositor 12 is 650V. In one embodiment of the present invention, connecting line 17 connects developer 11 to a power source and connecting line 20 connects depositor 12 to a current measuring means 16 such that the current flowing between the two rolls (11, 12) may be measured at all times during use. In FIG. 1, the area inside the dashed line shows the current measuring means 16 as a voltmeter and resistor in combination. The current measuring means 16 can be any conventional devices, such as the current meter (as shown in FIG. 2), for measuring electrical current. In the contact development transfer process, the movement of the plated ink from developer 11 to the ink receptor is a transfer process and not a development process so that the final print density is a function of the ink mass per unit area that was plated onto developer 11 by depositor 12. Printing to paper with constant optical density may be accomplished by printing with constant mass per unit area on developer 11.

A skive device (13 in FIGS. 1 and 19 in FIG. 2) is installed in a mechanical contact with developer roll 11. The skive 13 is in contact with the developer roll 11. The skive presses or scrapes against the developer roll to remove non-plated liquid ink retained on the surface of the developer roll or the plated ink composition on the developer roll 11. It is desirable to remove the ambient ink composition from the developer roll 11 as that ambient ink composition will have a significantly varying (with time and usage) particle concentration. Because a consistent concentration of particles is needed on the plated layer, the presence of a varying ambient liquid ink composition on the developer roll would lead to image density variations and background stain, which have been described as undesirable. The plated layer of ink on the developer roll 11 as previously noted has a concentration of particles that is higher than the concentration of particles in the ambient ink composition. It is the driving force of the biasing voltage that plates plated ink composition onto the surface of the developer roll 11 with a higher concentration of conductive particles in the plated layer than in the ambient ink composition. Skive device 13 (and 19) may be constructed with a conductive material and also be biased with an applied voltage (shown by dashed line 18 in FIG. 2) to prevent it from scraping plated toner off of developer roll 11 as it skives carrier liquid from the surface of the plated ink. In order to optimally function in the role of skive device, the applied voltage to skive device 13 (and 19) should be equal to or greater than the second voltage applied in depositor 12. The conductivity value of the material may depend on the required density. In the embodiment of the present invention, 650V is applied to the skive device. Skive device can be shaped such as a blade (13 in FIG. 1), a roll (19 in FIG. 2) and the like. Skive device 19 in FIG. 2, may be rotated by friction due to rotation of the developer 11. Otherwise, skive device 19 may be installed to rotate voluntarily by providing a separate drive mechanism. In one embodiment of the present invention, for an example purpose as shown in FIG. 2, skive device 19 rotates clockwise direction and the developer 11 rotates counterclockwise direction.

To clean the ink from the surface of developer 11, cleaning device 14 may be installed at one side of developer 11. There are numerous possible ways of providing a cleaning element, as long as cleaning device 14 does not wear the surface of developer 11. An example includes, but is not limited to a doctoring blade, squeegee, sponge, pad, scraper or the like scraping off or otherwise mechanically removing the ink from the surface of developer 11. In one embodiment of the present invention, a soft foam roll is adopted as cleaning device 14. As shown in FIG. 2, cleaning device 14 may be installed to contact developer 11, by which cleaning device 14 can be rotated by providing a separate drive mechanism such as a gear to allow cleaning device 14 to rotate voluntarily. One other way is that the cleaning device may be rotated by friction due to rotation of developer 11, which might not result in acceptable cleaning. In FIG. 1 of the embodiment of the present invention, developer 11 rotates in the direction shown and cleaning device 14 rotates in a direction opposite to developer 11. Ink container 10, in which developer 11, depositor 12, and cleaning device 14 are immersed in liquid ink 15, contains skive device 13 or 19, which is located either inside ink container or outside ink container.

There are several kinds of current measuring devices that could be used to practice this invention. Here are some examples.

The Hall Effect current meter—This meter gets its signal from a wire wrapped around the test channel wire so that the field that is generated by current flow can be externally measured without interrupting the operation of the primary circuit. More sensitivity is gained by wrapping more wire turns around the test channel wire to generate additional back EMF. One commercial sensor of this type is SYPRIS Hall Sensor Model MA-2000.

The Resistor current meter—This meter consists of a test resistor placed in the test channel circuit so that the current to be measured is actually flowing through the test resistor. A voltmeter is then arranged to measure the voltage around the resistor and relate the current flow according to E=IR. In this case, E is the measured voltage, I is the actual current flowing in the test channel circuit and R is the value of the test resistor. Care should be taken with this method to choose a test resistor large enough to get a good voltage signal but small enough to not interrupt the flow of current in the developer. This method is by far the most useful and cost-effective method of current sensing.

The Fluke current meter—This meter is made by the Fluke Corporation and is a multi-purpose voltmeter/ammeter/ohmmeter. In the current measuring mode, the test channel wire is broken and the Fluke meter is placed in the circuit in series with the broken test channel wire to make the wire "whole" again. The current flowing in the test channel thus flows through the Fluke meter and is measured by the Fluke meter.

In general, a new ink cartridge will comprise highly concentrated ink (a high percent solids of pigmented ink particles dispersed in a carrier liquid, as understood in the art) arranged to be at some ink level in the developing unit. As prints are made, both pigmented ink particles and carrier liquid will be carried out of the developing unit and thus, the ink level will be decreased. When the ink level begins to decrease, pure carrier solvent is added to the developing unit in order to maintain the desired ink level, which is approximately the same as the original ink level when the cartridge was new. Level sensors and liquid replenishment systems are quite simple and well known in the art of electrophotography; therefore, the details of the liquid level replenishment system are not offered in the present invention. In the embodiment of the present invention, an ink delivery device or ink container 10 or a level replenishment system (not shown) may be installed so that the desired level is maintained. As mentioned, these delivery and level replenishment systems are well known in the art; one example may be seen in the previously cited reference Song, et. al. (U.S. Pat. No. 6,766,130). The desired level of ink in ink container 10 is maintained for at least enough liquid to cover the bottom half of developer 11. In general, the desired level of ink is maintained such that fresh ink particles are continuously delivered to the vicinity of the gap (which defines the plating nip) between developer 11 and depositor 12. This is done such that the nip is not starved for available ink particles to be plated on the surface of developer 11. During the printing process, given that fresh ink particles are continuously delivered to the plating nip, the mass per unit area of plated ink particles on the surface of developer 11 will be largely determined by the difference of the first and second assigned voltages of developer 11 and depositor 12 respectively. If the voltage difference is made larger, the plated mass per unit area of ink particles on the surface of developer 11 may be made greater. As the surface of developer 11 exits from the liquid in the developing unit, it is coated with the plated ink layer that has depleted carrier solvent on its surface. The percent solids of the plated layer may be increased by passing developer 11 under the contacting conductive skive device 13 or 19 whose bias is made equal to or greater than the bias of depositor 12. Under these conditions and with an adjustment of the force assigned to skive device 13 or 19 against developer 11, excess carrier liquid may be removed without removing plated ink particles and the percent solids of the plated ink layer may be increased prior to contacting the surface of ink receptor with the surface of developer 11. The optimum force uniformly assigned to skive device 13 or 19 is a function of the compliance of developer 11. This force can be readily determined by trial and error.

A control scheme to maintain the constant density during a lifetime of the ink cartridge by controlling the plating current is described below. FIG. 3 explains a relation of the plating current generated by developer 11 and depositor 12, and the ink cartridge life during printing. The first voltage applied to developer 11 and the second voltage applied to depositor 12 cause an initial plating current 23 that can be measured between the two rolls. For the positively charged ink, the second voltage applied to depositor that is greater than the first voltage applied to developer 11 will cause ink to be deposited on the surface of developer 11 in the plating nip. (This will be the case when the first voltage applied to developer 11 is greater than the second voltage applied to depositor 12, for negatively charged ink). As the cartridge ages, i.e., printing proceeds, the applied voltages remain constant but the trend of the current 21 may not remain constant. In an embodiment of the present invention, the lowest value 22 is shown to represent the current at the end of life of the cartridge, i.e., not enough fresh ink particles are available to be or are not supplied to the plating nip. This plating current curve as a function of cartridge life for constant applied voltages is stored in a lookup table (LUT1) for use by the printing computer. FIG. 4 shows a graph of the voltage difference between the developer and the depositor necessary to achieve constant mass per unit area (M/A) on the developer over the life of the ink cartridge. The initial value 33 is when the first voltage is applied to developer 11 and the second voltage is applied to depositor 12, and is mapped with the initial current 23 in FIG. 3. The initial value 33 may represent an initial percent solids of the ink in the new cartridge, as well. As printing proceeds, i.e., the cartridge ages, the the voltage difference between the developer and the depositor necessary to plate constant mass per unit area (M/A) becomes greater than the initial the voltage difference between the developer and the depositor until the end of life of the cartridge. During the printing, the available ink solids or ink solids concentration will decrease, the ink conductivity may change and the ink mobility may change but these effects are all considered by recording the current required to plate a specified mass per unit area on developer 11 at all points in the life of the cartridge. The end of the cartridge life is defined as the point where the voltage difference between the developer bias and the deposition roll bias is greater than a specified maximum difference that is necessary to produce the required plating current for the desired mass per unit area on the developer. The voltage difference curve 31 assumes a final value 32 signifying the end of life for that cartridge, i.e., the last print in the cartridge life. The ink percent solids may be measured at this end-of-life point. The voltage difference curve as a function of cartridge life for constant M/A may be scaled between initial percent solids and final percent solids, and is stored in a lookup table (LUT2) for use by the printing computer.

By using the first LUT source (LUT1), the printing machine can know how old its ink cartridge might be and the concentration of available solids therein at any time and therefore know what bias voltages to apply to developer 11 and depositor 12 for the specified mass per unit area by accessing the second LUT (LUT2). This kind of simple current monitoring during operation can occur at any time but specifically can occur even when developer 11 is not in contact with the ink receptor such as when the developing unit is disengaged. The use of the ink receptor is not needed to discover the correct voltage settings for printing to a specified print density. Similarly, no external density measurement system is needed to measure the density of test patches because no plated test patches are needed with this method. Furthermore, no direct sensing of the ink percent solids or conductivity or mobility is necessary for the printing of constant density throughout the life of the ink cartridge. Because inks can be manufactured to be quite similar in property from batch to batch, the printing machine LUT information may be programmed into the printer at the point of manufacture and should not need modification throughout the life of the printer itself.

The requirement that ink density should remain constant and invariant has been troublesome when the ink varies in its concentration and its conductivity within the ink container during printing process. The requirement of constant and invariant image density may be met by the apparatus and method in accordance with the present invention. The structure of developing roll and depositor immersed in the ink container of the developing unit are also advantageous over conventional developing unit configurations.

Although means may be required to maintain a constant volume of liquid ink in the ink tank or container, the voltages and currents are not monitored and adjusted for the purpose of adding any additional liquid ink or for the addition of any component thereof (e.g. charge director, carrier liquid, solids, etc.). Rather, this invention allows the printing apparatus to make use of the liquid ink available, even if the percent solids is higher or lower than optimal, or even if the charge director level of the liquid ink is not optimal, for example.

The hardware architecture of this invention adjusts to accommodate the constantly changing characteristics of the ink supplied.

Other enabled embodiments are described within the following claims.

What is claimed is:

1. An ink developing unit comprising:

a) a developer roll comprising a developer roll surface and a first voltage is applied to said developer roll surface;

b) a charge depositor, wherein said charge depositor is positioned to maintain a gap with said developer roll and a second voltage is applied to said depositor;

c) a cleaning device for said developer roll, wherein said cleaning device is in contact with the developer roll surface or an ink layer plated on the developer roll surface; and d) an ink container, wherein said developer roll, said depositor and said cleaning device are inside said ink container, wherein a current measuring device is present to measure current flow between said depositor and said developer roll, or a voltage meter is present to measure a voltage across a known resistor that is in series with a power supply to the depositor.

2. A developing unit according to claim 1, further comprising a skive device.

3. A developing unit according to claim 2, wherein said skive device comprises a skive roll.

4. A developing unit according to claim 2, wherein said skive device comprises a skive blade.

5. A developing unit according to claim 1, further comprising a positively charged ink.

6. A developing unit according to claim 1, further comprising a negatively charged ink.

7. A developing unit according to claim 1, wherein said developer roll comprises a roll.

8. A developing unit according to claim 1, wherein said developer roll comprises overall volume resistivity being less than or equal to $10^3$ Ω-cm.

9. A developing unit according to claim 1, wherein said developer roll comprises overall volume resistivity being at least $10^5$ Ω-cm.

10. A developing unit according to claim 1, wherein said depositor comprises overall volume resistivity being less then or equal to $10^3$ Ω-cm.

11. A developing unit according to claim 1, wherein said depositor comprises a roll.

12. A developing unit according to claim 1, wherein said cleaning device comprises a roll.

13. A developing unit according to claim 1 further comprises a current measuring means connected to said depositor and said developer roll for measuring current flow between said depositor and said developer roll.

14. An ink developing unit comprising:

a) a developer roll comprising a developer roll surface and a first voltage is applied to said developer roll surface;

b) a charge depositor, wherein said charge depositor is positioned to maintain a gap with said developer roll and a second voltage is applied to said depositor;

c) a cleaning device for said developer roll, wherein said cleaning device is in contact with the developer roll surface or an ink layer plated on the developer roll surface;

d) an ink container, wherein said developer roll, said depositor and said cleaning device are inside said ink container; and e) a skive device;

wherein a current measuring device is present to measure current flow between said depositor and said developer roll, or a voltage meter is present to measure a voltage across a known resistor that is in series with a power supply to the depositor wherein said second voltage is applied to said skive device which comprises a conductive material.

15. A method for maintaining constant density in an electrophotographic imaging process comprising the steps of:

a. Providing a developing unit comprising a developer, a depositor, a cleaning device, and an ink container, wherein said developer, said depositor and said cleaning device are inside said ink container;

b. Providing an ink in said ink container;

c. Applying a first voltage to said developer;

d. Moving said developer;

e. Applying a second voltage to said depositor; and f. Controlling a plating current between said developer and said depositor to obtain a constant thickness of ink plated on a surface of said developer by adjusting said first voltage, said second voltage, or a combination thereof.

16. A method for maintaining constant density according to claim 15, wherein at least one of said first voltage and said second voltage is determined by reference to at least one lookup table.

17. A method for maintaining constant density according to claim 15, wherein said second voltage is greater than said first voltage when said ink is a positively charged ink.

18. A method for maintaining constant density according to claim 15, wherein said first voltage is greater than said second voltage when said ink is a negatively charged ink.

19. An ink developing unit comprising:

a) a developer roll comprising a developer roll surface and a first voltage is applied to said developer roll surface;

b) a charge depositor, wherein said charge depositor is positioned to maintain a gap with said developer roll and a second voltage is applied to said depositor;

c) a cleaning device for said developer roll, wherein said cleaning device is in contact with the developer roll surface or an ink layer plated on the developer roll surface;

d) a skive device; and e) an ink container, wherein said developer roll, said depositor and said cleaning device are inside said ink container, wherein a current measuring device is present to measure current flow between said depositor and said developer roll, or a voltage meter is present to measure a voltage across a known resistor that is in series with a power supply to the depositor, and wherein the results of measuring the current or the voltage direct control of a plating current between said developer roll and said depositor to obtain a constant thickness of ink plated on a surface of said developer roll by adjusting at least one said first voltage, said second voltage, or a combination thereof.

* * * * *